US007237346B2

(12) United States Patent
Lebo

(10) Patent No.: US 7,237,346 B2
(45) Date of Patent: Jul. 3, 2007

(54) INSOLE WITH CUSHION INSERT

(75) Inventor: Jonathan K. Lebo, Lebanon, PA (US)

(73) Assignee: Columbia Insurance Company, Omaha, NE (US)

( * ) Notice: Subject to any disclaimer, the term of this patent is extended or adjusted under 35 U.S.C. 154(b) by 227 days.

(21) Appl. No.: 10/888,928

(22) Filed: Jul. 9, 2004

(65) Prior Publication Data

US 2006/0005428 A1 Jan. 12, 2006

(51) Int. Cl.
*A43B 13/12* (2006.01)
*A43B 13/18* (2006.01)

(52) U.S. Cl. ..... 36/28; 36/44; 36/30 R

(58) Field of Classification Search ..... 36/25 R, 36/28, 29, 44, 30 R, 30 A
See application file for complete search history.

(56) References Cited

U.S. PATENT DOCUMENTS

| | | | | |
|---|---|---|---|---|
| 2,055,574 | A * | 9/1936 | Hartl | 36/44 |
| 2,126,601 | A * | 8/1938 | Bain | 36/19.5 |
| 2,405,224 | A * | 8/1946 | Margolin | 36/30 R |
| 2,502,774 | A * | 4/1950 | Alianiello | 36/28 |
| 4,783,910 | A * | 11/1988 | Boys et al. | 36/107 |
| 4,794,707 | A * | 1/1989 | Franklin et al. | 36/107 |
| 5,435,078 | A * | 7/1995 | Pyle | 36/30 R |
| 5,787,609 | A * | 8/1998 | Wu | 36/28 |
| 5,918,383 | A * | 7/1999 | Chee | 36/28 |
| 6,038,790 | A * | 3/2000 | Pyle et al. | 36/30 R |
| 6,120,880 | A * | 9/2000 | Crow | 428/167 |
| 6,176,025 | B1 * | 1/2001 | Patterson et al. | 36/28 |
| 6,574,886 | B1 * | 6/2003 | Issler | 36/12 |
| 6,589,630 | B1 * | 7/2003 | Crow | 428/167 |
| 2001/0015022 | A1 * | 8/2001 | Singer et al. | 36/28 |
| 2004/0181970 | A1 * | 9/2004 | Covatch | 36/30 R |

* cited by examiner

*Primary Examiner*—Marie Patterson
(74) *Attorney, Agent, or Firm*—St. onge Steward Johnston & Reens LLC

(57) ABSTRACT

The invention relates to a shoe having an insole being of a rigid material for providing structural integrity to be secured to an outsole, an upper secured to the insole, and a hole in the insole for enhancing flexibility of the insole. The insole is then secured to both the outsole and the upper. The invention also relates to a method for providing the shoe.

12 Claims, 4 Drawing Sheets

INSOLE WITH CUSHION INSERT

FIELD OF THE INVENTION

The invention relates to an improved shoe construction.

BACKGROUND OF THE INVENTION

An insole is generally defined in the trade to be a material to which an upper and an outsole are secured. In a typical lasted shoe construction, an insole is temporarily secured to an underside of a last and the upper may be pulled down and around the underside of the insole. The upper may then be wiped, or shaped, about the last prior to attachment to the insole. Once the upper is secured, either by cement or stitch, to the underside of the insole, and after the insole is secured to an outsole either by fasteners or cement, the last is usually removed. The typical resulting structure is the upper being indirectly secured to the outsole where the insole is connecting both the upper and outsole together.

Because the insole normally provides a base to which the upper is attached, and because the insole often links and secures the upper to the outsole, the insole is generally made of a material having sufficient structural integrity. A soft material may easily flex or buckle when the shoe is subjected to stress, possibly resulting in the insole separating from the cement or fasteners and, therefore, causing the insole to separate from the outsole and/or upper. Hence, the insole is often a rigid material so as to minimize the disadvantages described above and inhibit parts of the shoe from falling apart. As one may imagine, utilizing a rigid, strong material having sufficient structural integrity may often result in an insole that has reduced flexibility.

In some cases, an inflexible insole causes the shoe to be uncomfortable, particularly if a wearer's foot directly contacts the insole. As shoe construction evolved, comfort was improved by placing a cushion on top of the insole for directly receiving the wearer's foot. Instead of, or in addition to, the cushion, a footbed or socklining may be used. Further, using a cushion, footbed, or socklining of soft or resilient material may also permit these items to be easily flexed. However, despite the addition of a cushion, footbed, or socklining, the flexibility or comfort of the insole may be unaffected.

U.S. Pat. No. 4,115,934 to Hall, U.S. Pat. No. 6,178,663 to Schoesler, U.S. Pat. No. 5,438,768 to Bauerfeind, and U.S. Pat. No. 6,598,319 to Hardt appear to disclose an inner sole or insole having a flexible or cushioned insert to improve flexibility and/or cushioning. The inner sole or insole may directly receive the wearer's foot and does not tend to show the inner sole or insole as a structure for indirectly securing the upper to the outsole where the insole is connecting both the upper and outsole together. In some cases, the inner sole or insole may be inserted into the shoe. Hence, these references that refer to an inner sole or insole do not employ the use of an insole as defined by this specification.

What is desired, therefore, is a shoe having an insole with improved flexibility without sacrificing structural integrity. Another desire is a shoe having an insole with improved comfort.

SUMMARY OF THE INVENTION

It is, therefore, an object of the invention to provide a shoe having an insole that has improved flexibility without sacrificing strength or structural integrity.

Another object is to provide a shoe having an insole that enhances comfort to a user.

These and other objects of the invention are achieved by a shoe comprising

An insole being of a rigid material for providing structural integrity to be secured to an outsole, an upper secured to the insole, and a hole in the insole for enhancing flexibility of the insole. The insole is then secured to both the outsole and the upper.

The hole may extend from a first side to a second side of the insole or from a first side to a point between the first and second sides. In some embodiments, the upper is stitched to the insole. In other embodiments, the upper is adhered to the insole. For added comfort to a user, a cushion or footbed may be placed on a top surface of the insole. Optionally, a socklining may be placed on a top surface of the insole for providing a smooth surface that is adapted to receive a user's foot.

In another embodiment of the shoe, flexible material is placed within the hole, wherein the flexible material enhances comfort of the shoe. The flexible material may be a gel.

In a further embodiment of the shoe, a plurality of holes may be used to enhance flexibility of the shoe.

In another aspect of the invention, a method for providing a shoe includes the steps of providing an upper, providing an insole of rigid material, and providing a hole in the insole for enhancing flexibility. The method also includes the step of placing flexible material in the hole for enhancing comfort, securing the upper to the insole, and securing the insole to the outsole.

In some embodiments, the method may include the step of extending the hole from a first side to a second side of the insole. In other embodiments, the method may extend the hole from a first side to a point between the first and second sides.

The upper may either be stitched or adhered to the insole. The method may also include the optional step of placing a cushion, footbed, or socklining on a top surface of the insole for further enhancing comfort to a user.

DETAILED DESCRIPTION OF THE DRAWINGS

Figure 1:
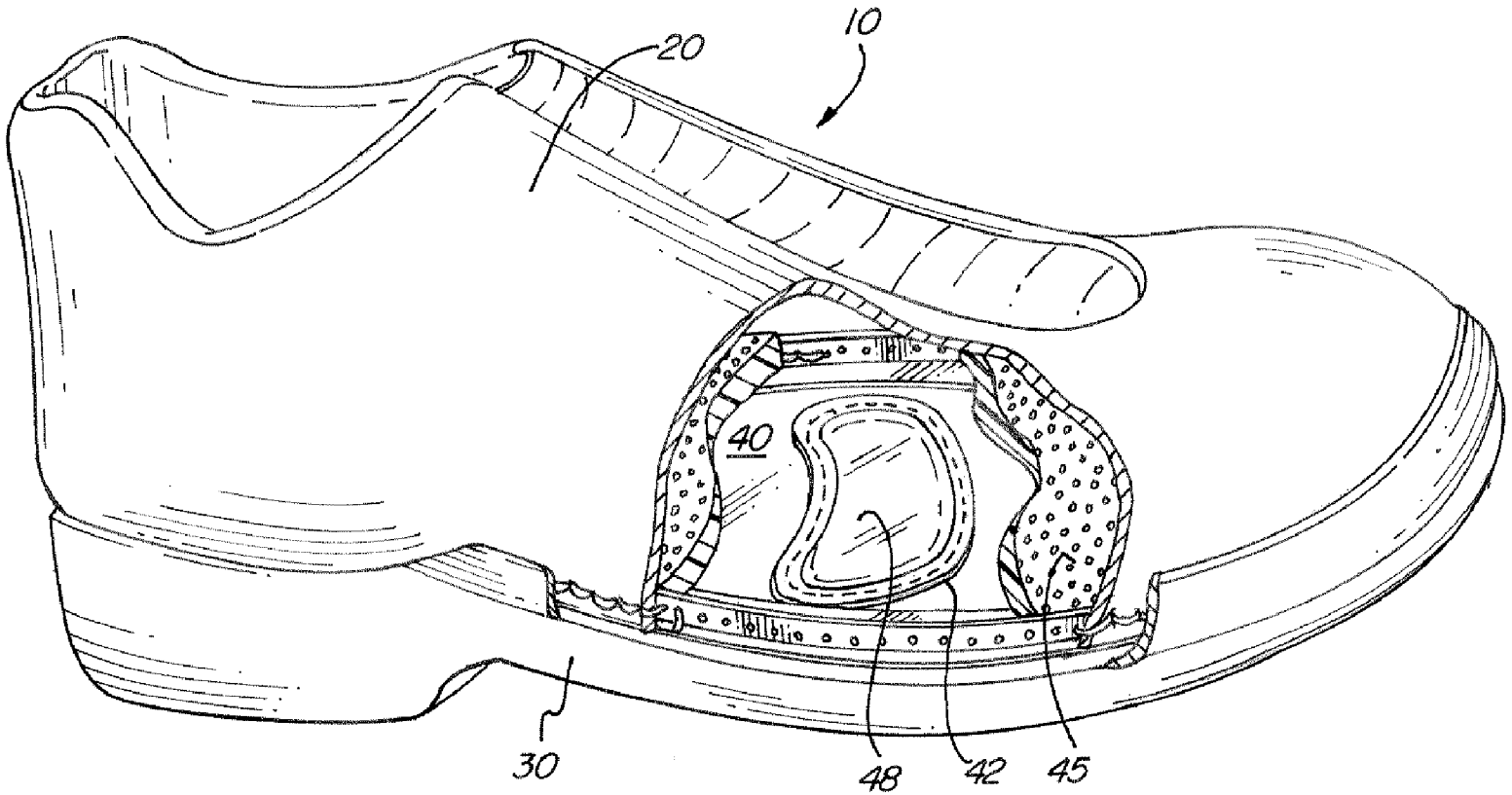
FIG. 1 depicts the shoe in accordance with the invention.

FIG. 1 depicts shoe 10 having improved construction in accordance with the invention. Shoe 10 includes upper 20, outsole 30, and insole 40 which secures upper 20 to outsole 30.

Figure 2:
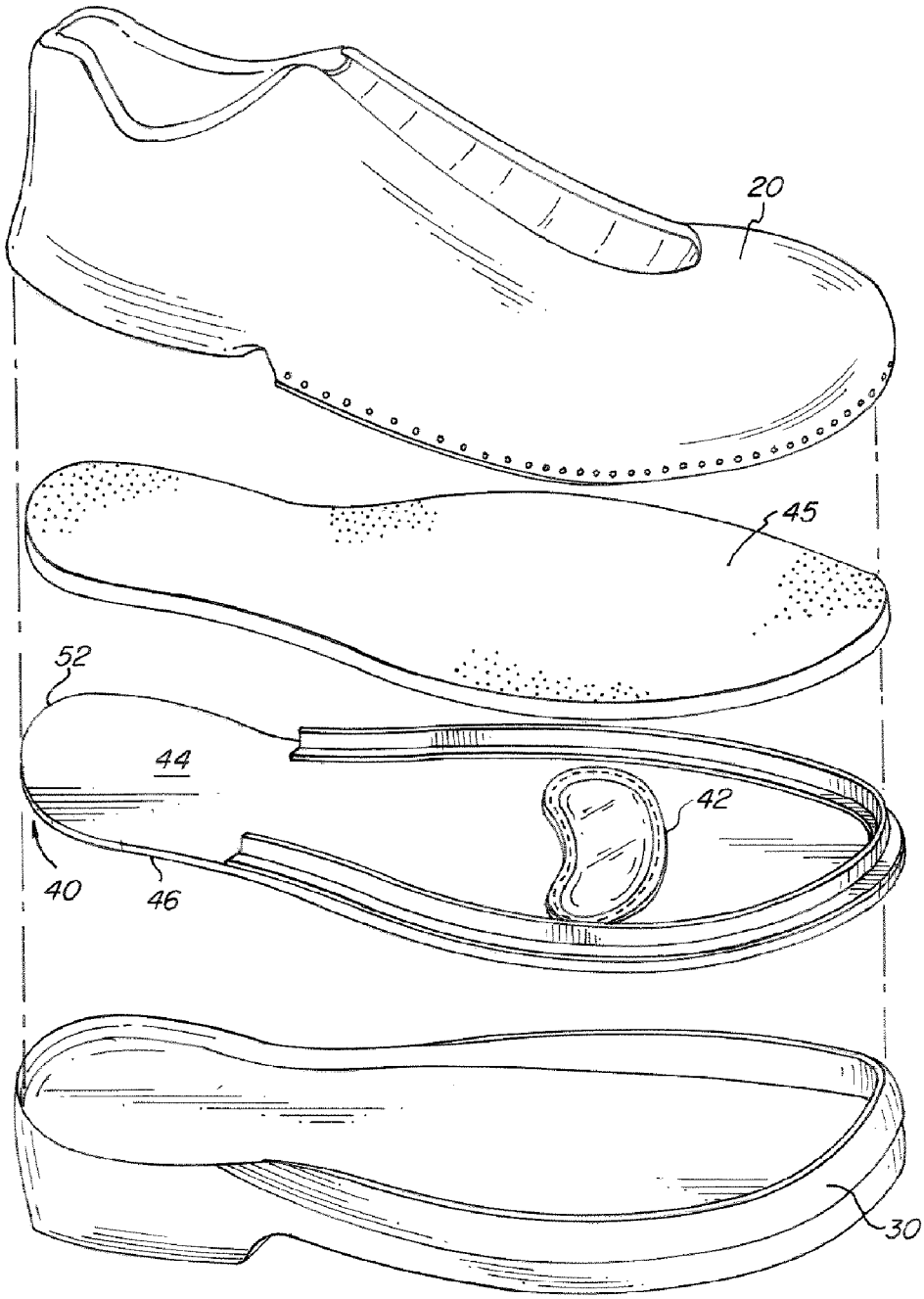
FIG. 2 depicts an assembly view of the shoe shown in FIG. 1.

As shown in FIGS. 1 and 2, upper 20 is secured to insole 40 and insole 40 is secured to outsole 30. Hence, insole 40 is a significant element of shoe 10 because a weak, or lack of structural integrity in, insole 40 may cause upper 20 or outsole 30 to separate from insole 20 since any fastener or stitch, which may be used to secure upper 20 or outsole 30 to insole 40, would lack an anchoring mechanism to which to be secured.

For example, if a screw or rivet is used to secure insole 40 to outsole 30, the hole through which the screw or rivet passes may stretch around, and loosen insole 40, from the screw or rivet.

Therefore, insole 40 is made of a rigid material having sufficient structural integrity to provide an anchoring mechanism to which upper 20 and/or outsole 30 is secured. Generally, insole 40 is made of needle punch poron or Texon, although other suitably, strong materials may be used instead.

Figure 3:
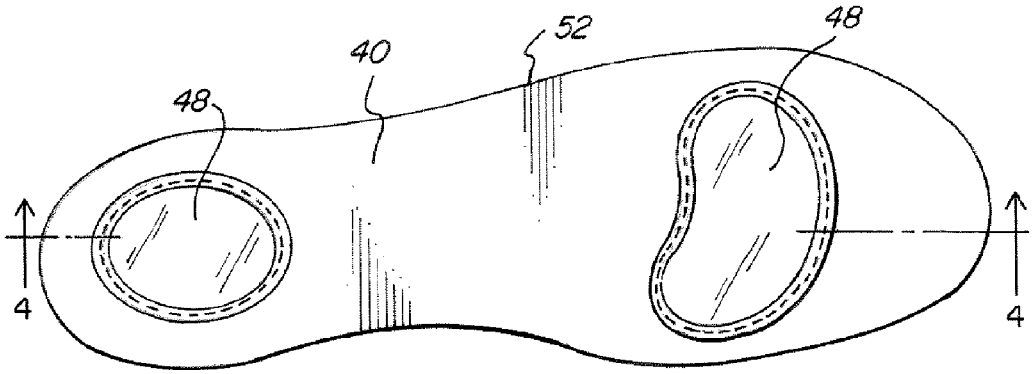
FIG. 3 depicts a top view of the insole shown in FIG. 1.
Figure 4:
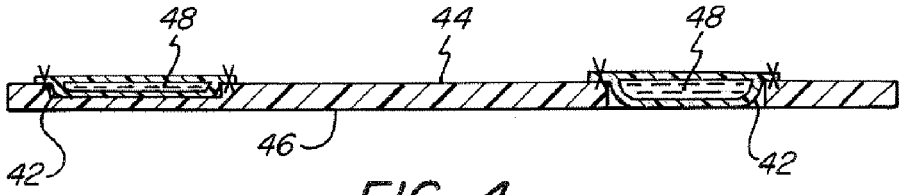
FIG. 4 depicts a cross sectional view of the insole shown in FIG. 1.

In reference to FIGS. 2–3, insole 40 also includes hole 42, which may be a through hole extending from top surface 44 to bottom surface 46 or from either top or bottom surface 44, 46 to a location between the two surfaces, or a hole that extends partially through a thickness of insole 40.

By removing material from insole 40 by providing hole 42, the flexibility of insole 40 is enhanced because there is less rigid material and, therefore, less resistance inhibiting insole 40 from bending when worn by a user. Yet, because the remainder of insole 40, particularly periphery 52 of insole 40, is made of the rigid material, insole 40 maintains sufficient structural integrity.

Although hole 42 enhances flexibility, a hole extending from top surface 44 to bottom surface 46 may cause discomfort or an uneven feeling to the user because the user's foot not be adequately supported when the foot is placed above hole 42.

To alleviate this discomfort, while still enhancing flexibility, hole 42 may be placed in select areas of insole 40, such as the arch area since the lack of support for the arch of the user's foot due to hole 42 in insole 40 may be overcome by providing adequate support with footbed 95, or cushion placed on top surface 44.

In another aspect of insole 40, hole 42 may extend partially through a thickness of insole 40 from bottom surface 46 to a location between top and bottom surfaces 44, 46. In this aspect of hole 42, top surface 44 is relatively flat so as to receive the user's foot without the uneven feeling, yet material is removed from insole 40 for enhancing flexibility.

Flexible material 48 may optionally be placed within hole 42 in any of the above aspects of insole 40 to alleviate discomfort due to a lack of support from the user's foot being placed above hole 42. Flexible material 48 is any material permitting ample flexing when the shoe is worn. Examples of flexible material 48 include a vitalize gel of polyurethane elastomer.

In aspects of insole 40 having flexible material 48, hole 42, whether partially extending through or all the way through the thickness of insole 40, may extend from top surface 44 without concern for the uneven feeling described above since flexible material 48 would occupy hole 42.

In addition to permitting ample flexing, flexible material 48 may also enhance comfort to the user since flexible material 48 provides resiliency, characteristic of a footbed or cushion placed above insole 40. It is understood that the shape and placement of hole 42 and flexible material 48 is not limited to those shown in the figures. In some embodiments, hole 42 is placed in an arch region. In further embodiments, hole 42 is placed in a plurality of areas of insole 40. Also, the shape of hole 42 need not be symmetric or have uniform depth through a thickness of insole 40. Any variation of shape or location is envisioned by the invention.

Figure 5:
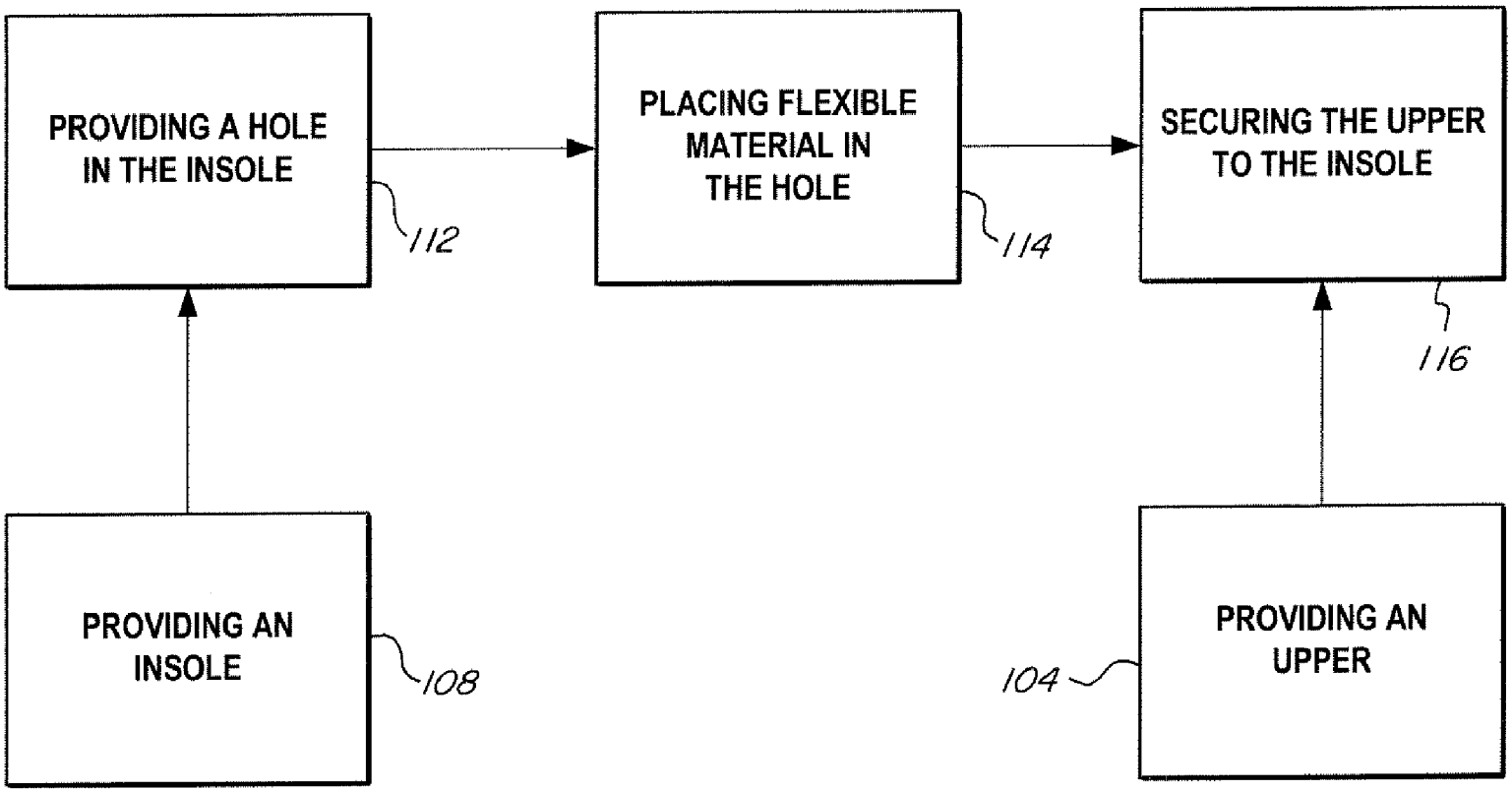
FIG. 5. depicts a method for providing the shoe shown in FIG. 1.

As shown in FIG. 5, method 100 for providing the shoe shown in FIGS. 1–4 is shown. Method 100 includes the steps of providing 104 an upper, providing 108 an insole of rigid material, and providing 112 a hole in the insole for enhancing flexibility of the insole. Method 100 further includes placing 114 flexible material in the hole for enhancing comfort to a user, securing 116 the upper to the insole, and securing 118 the insole to the outsole.

What is claimed is:

1. A shoe comprising an insole being of a rigid material for providing structural integrity to be secured to an outsole;

said insole having a hole extending from a first outermost surface to a second outermost surface;

an upper stitched to said insole;

said insole being between the outsole and said upper;

a cushion placed in said hole and being generally flush with said first and second outermost surfaces;

a stitch for stitching said cushion to said insole; and wherein said hole enhances flexibility of said insole.

2. The shoe according to claim 1, further comprising a cushioning placed on a top surface of said insole.

3. The shoe according to claim 1, further comprising a footbed placed on a top surface of said insole.

4. The shoe according to claim 1, further comprising a socklining placed on a top surface of said insole.

5. The shoe according to claim 1, wherein said cushion is selected from the group consisting of a vitalize gel, a polyurethane elastomer, and combinations thereof.

6. A shoe, comprising:

an insole being of a rigid material for providing structural integrity to be secured to an outsole;

said insole having a hole extending from a first outermost surface to a second outermost surface;

an upper stitched to said insole;

a flexible material placed within said hole and being generally flush with said first and second outermost surfaces;

said insole being stitched to the outsole and said upper;

a stitch for stitching said flexible material to said insole;

wherein said hole enhances flexibility of said insole; and wherein said flexible material is selected from the group consisting of a vitalize gel, a polyurethane elastomer, and combinations thereof.

7. The shoe according to claim 6, wherein said flexible material is a gel.

8. The shoe according to claim 6, wherein said insole further comprises a plurality of holes for enhancing flexibility of said insole.

9. A method for providing a shoe, comprising:

providing an upper;

providing an insole of rigid material;

providing a hole in the insole extending from a first outermost surface to a second outermost surface for enhancing flexibility;

placing flexible material in the hole that is generally flush with both the first and second outermost surfaces for enhancing comfort;

stitching the upper to the insole;

securing the insole to the outsole; and stitching the flexible material to the insole.

10. The method according to claim 9, further comprising the step of placing a cushion on a top surface of the insole.

11. The method according to claim 9, further comprising the step of providing a plurality of holes in the insole for enhancing flexibility of the insole.

12. The method according to claim 9, further comprising the step of securing a welt to the insole and securing the upper to the welt.

* * * * *